US008879368B2

(12) United States Patent
Jacobi, Jr.

(10) Patent No.: US 8,879,368 B2
(45) Date of Patent: Nov. 4, 2014

(54) APPARATUS FOR HOROLOGE WITH REMOVABLE AND INTERCHANGEABLE FACE

(71) Applicant: James J. Jacobi, Jr., St. Augustine, FL (US)

(72) Inventor: James J. Jacobi, Jr., St. Augustine, FL (US)

( * ) Notice: Subject to any disclaimer, the term of this patent is extended or adjusted under 35 U.S.C. 154(b) by 0 days.

(21) Appl. No.: 13/904,007

(22) Filed: May 28, 2013

(65) Prior Publication Data

US 2013/0315043 A1 Nov. 28, 2013

Related U.S. Application Data

(60) Provisional application No. 61/652,070, filed on May 25, 2012, provisional application No. 61/692,845, filed on Aug. 24, 2012.

(51) Int. Cl.
*G04B 19/06* (2006.01)
*G04B 45/00* (2006.01)

(52) U.S. Cl.
CPC ..... *G04B 45/0092* (2013.01)
USPC ..... 368/232; 368/228

(58) Field of Classification Search
USPC ..... 368/228–237, 76, 80, 88, 276, 285, 368/294–295, 314
See application file for complete search history.

(56) References Cited

U.S. PATENT DOCUMENTS

| | | | | |
|---|---|---|---|---|
| 4,660,992 | A | 4/1987 | Paul et al. | |
| 5,008,869 | A | 4/1991 | Dweck | |
| 5,018,118 | A * | 5/1991 | Ross | 368/228 |
| 5,380,206 | A * | 1/1995 | Asprey | 434/257 |
| 5,793,710 | A | 8/1998 | Jacobi, Jr. | |
| 7,035,171 | B2 | 4/2006 | Hurni et al. | |
| 7,177,234 | B1 * | 2/2007 | Paul | 368/88 |
| 7,267,480 | B1 * | 9/2007 | Hasson | 368/286 |
| 7,784,655 | B2 * | 8/2010 | Su | 224/163 |
| 2004/0141423 | A1 * | 7/2004 | Hurni et al. | 368/232 |

* cited by examiner

*Primary Examiner* — Sean Kayes
(74) *Attorney, Agent, or Firm* — Hodgson Russ LLP

(57) ABSTRACT

The present invention discloses a horologe, such as a watch or clock, in which a removable and interchangeable face can be inserted and removed from the horologe and replaced with another face without disconnecting components of the horologe or interfering with the horologe measuring time. In one embodiment, the horologe comprises a horological movement; a housing having a rim and a mount plate, a removable face for insertion into a faceplate compartment, and an inner transparent cover. A portion of the rim may be extendable away from the housing to reveal an opening to receive a removable face. In one embodiment, the horologe may comprise an extendable drawer, which is adapted for insertion into and selectably extendable from the faceplate compartment. In one embodiment, the horologe may comprise an outer bezel, which has open and closed positions for revealing and covering the opening of the faceplate compartment.

15 Claims, 18 Drawing Sheets

APPARATUS FOR HOROLOGE WITH REMOVABLE AND INTERCHANGEABLE FACE

CROSS-REFERENCE TO RELATED APPLICATIONS

This application claims priority to U.S. Provisional Application No. 61/652,070, filed on May 25, 2012, and U.S. Provisional Application No. 61/692,845, filed on Aug. 24, 2012, the disclosures of which are incorporated herein by reference.

FIELD OF THE INVENTION

The invention generally relates to a horologe, such as a watch or clock, having an apparatus that allows a removable and interchangeable dial or face to be selectively removed or inserted.

BACKGROUND OF THE INVENTION

A number of horologes have been developed with removable or moveable faces or dials. Such devices are disclosed for example in U.S. Pat. Nos. 619,078, 1,503,097, 2,132,051, 3,111,003, 3,465,512, 3,817,022, 4,034,555, 4,444,513, 4,525,077, 4,541,727, 4,660,992, 5,008,869, 5,018,118, 5,168,479, 5,224,078 and 5,793,710. Only U.S. Pat. No. 5,793,710 (the "'710 patent") discloses a timepiece with faces that are easy to remove and exchange with other faces while maintaining the integrity and functionality of the timepiece. But, the '710 patent requires the complete removal of a portion of the housing of the horologe in order to remove and replace faces. Removal of a portion of the horologe's housing, such as the removable rim assembly, is problematic because it increases the possibility of losing or damaging the removable components, requiring the production of a significant number of replacement parts. And since each removable face is intended to be coupled with a removable rim assembly, an equal number of removable faces and removable rim assemblies would need to be produced for coupling, adding to the cost of production.

BRIEF SUMMARY OF THE INVENTION

The present invention discloses a horologe, such as a watch or clock, in which a removable and interchangeable face can be removed easily and replaced with another removable face without disjoining a portion of the housing from the horologe or interfering with the horologe's primary function—to measure time. Many modern timepieces with analog displays either have no dial or face, such as skeleton watches and clocks, or have faces without time-indicating indicia. While the present invention discloses a horologe with removable and interchangeable faces or dials with and without time-indicating indicia, it may include numeric or non-numeric time-indicating indicia on other components of the horologe, such as a mount plate or bezel. Being able to remove and replace faces from horological devices, such as watches and clocks, allows a significantly greater degree of self-expression for the user of the timepiece; with the added benefit of not having to purchase a new timepiece every time the owner wishes to express a different mood or fashion statement. Although the horologes described in the claims of the '710 patent make it easy to remove and replace faces while maintaining the integrity and functionality of the timepiece, in order to do so such horologes require certain components of the timepiece to be completely separated from the housing of the watch or clock. This is necessary in order to provide access and egress for the removable faces. Not only can disjoining these components from the horologe increase the possibility of losing or damaging any of these components (for example, parts of the removable rim assembly, coupled to the removable faces). Also, the production of individual coupling components equal in number to every removable and interchangeable face would likely be required. Additionally, for the timepieces described in the '710 patent with removable rim assemblies, production would require significant precision in manufacturing, to exacting specifications such that all the removable rim assemblies would fit universally within narrow tolerances in all similar timepieces.

Having the ability to remove and replace the face is very advantageous, whether from a watch on the wearer's wrist or a clock hanging on a wall. This is particularly true when removing and replacing the face can be done quickly and easily, without concern for losing or damaging components or needing to manufacture quantities of additional precision components equal in number to the sum of all removable faces produced. The prior art has failed to achieve this. The present invention creates inexpensive and practical alternatives for removing and interchanging faces in a simple movement, while all portions of the housing of the horologe remain in communication with the horologe.

The horologe of the present invention may comprise a housing, which, along with a substantially flat mount plate, protects, a horological movement. The horologe may have either an analog or digital display. An analog display would normally include a shaft, which extends from the mount plate in a substantially perpendicular direction; and at least one hand of the horologe is attached to the shaft. The hand extends from the shaft in a direction substantially parallel to the mount plate. A rim extends around the periphery of the housing. A portion of the rim is extendable away from the housing. A transparent crystal, which may be made of a material typically used in timepieces, such as acrylic glass, and an inner transparent cover may be attached to the non-extendable portion of the rim above the mount plate.

The horologe may further comprise an extendable faceplate drawer, which is adapted for insertion into, and selectably extendable from, a segregated faceplate compartment, which is the space between the mount plate and the inner transparent cover. The faceplate drawer may be adapted to receive a removable face. Included in the central area of the faceplate drawer may be an aperture of a size sufficient to permit the shaft to extend therethrough, and a linear passage extending radially from the central aperture toward a perimeter of the faceplate drawer. The horologe may further comprise an extendable rim assembly comprising the extendable portion of the rim, a means for attaching the extendable faceplate drawer to the extendable portion of the rim, and two flexible, resilient tabs each being attached to different ends of the extendable portion of the rim for engagement with and attachment to the non-extendable portion of the rim.

The removable face may be used in place of non-removable faces and dials, which are fixed components of most timepieces. The removable face may be thin and substantially flat, and made of a flexible, resilient material on which graphic imagery can be applied by various techniques, including different methods of printing. The face may have an aperture at its central area which, when inserted into the extendable faceplate drawer, aligns with the central aperture of the extendable faceplate drawer, and is of a size sufficient to permit the shaft to extend therethrough. The face also may have a linear passage extending radially from its central aperture toward the perimeter of a face, which when inserted into the extendable faceplate drawer aligns with the linear passage of the extendable faceplate drawer. Aligning the central apertures and linear passages of the removable face and the extendable faceplate drawer, ensures a set position for the removable face when inserted in the extendable faceplate drawer, which will result in optimal viewing of the removable face through both the transparent crystal and the inner transparent cover of the timepiece when the extendable faceplate drawer is inserted into the faceplate compartment.

The extendable rim portion and the extendable faceplate drawer of the present invention may be extendable from the housing of the horologe, and may remain connected to the housing by means of two faceplate drawer guides. The guides may be made of resilient, durable, yet elastic material, such as tempered steel. One end of each of the faceplate drawer guides may be secured to different sides of the faceplate drawer. The other end of each of the faceplate drawer guides may include an affixed nub, such as an extension of the guide bent back toward itself. So as to allow the faceplate drawer guides to slide easily along a segregated track located between the non-extendable portion of the rim and the housing, the nub end of each of the faceplate drawer guides is not attached to the housing. When the extendable portion of the rim and the attached faceplate drawer are extended away from the housing, the faceplate drawer guides also slide along the track in that direction. At the point where the faceplate drawer is fully extended from the housing, the track may include a stopper, which may be made of durable and resilient material for engaging the nub, thus preventing the faceplate drawer guides from separating from the track of the housing. When the extendable faceplate drawer slides into the faceplate compartment, the faceplate drawer guides also slide along the track in the same direction. To further stabilize the extendable faceplate drawer so as to remain substantially parallel to the plane of the mount plate when fully extended from the segregated faceplate compartment, the present invention may have a movable armature ring having a similar circumference as the extendable faceplate drawer.

The movable armature ring may be made of a durable material and may be located adjacent and parallel to the mount plate of the housing. The extendable faceplate drawer may include a flexible and resilient clip for engaging and disengaging the armature ring. As the faceplate drawer is inserted into the faceplate compartment, the clip engages the armature ring, allowing both the faceplate drawer and the armature ring to move in unison as the insertion of the faceplate drawer is completed. Having the clip engage the armature ring also ensures that the armature ring will move in unison with the faceplate drawer as the faceplate drawer begins to move out of the faceplate compartment. While the extendable faceplate drawer is able to extend from the segregated faceplate compartment, the movable armature ring is prevented from extending beyond a certain point by the shaft of the timepiece. At the point the armature ring reaches the shaft and the faceplate drawer continues to move out of the faceplate compartment, the clip disengages from the armature ring. Prevented from extending any further by the shaft, the armature ring acts as a counterweight, stabilizing the faceplate drawer and counterbalancing its weight when the faceplate drawer is fully extended from the faceplate compartment.

The invention may be embodied as a horologe with an analog display comprising: (a) a housing which, along with a substantially flat mount plate, encloses a horological movement; (b) a shaft extending in a substantially perpendicular direction from the plane of the mount plate and being operationally connected to the horological movement; (c) at least one hand attached to the shaft and extending in a direction substantially parallel to the plane of the mount plate; (d) a rim extending around the periphery of the housing, the rim having an extendable rim assembly and a non-extendable rim portion; (e) an inner transparent cover and an outer transparent crystal attached to the non-extendable rim portion above the mount plate and defining an enclosed space, the crystal being disposed above the hand and the inner cover being disposed below the hand, the inner cover is spaced from the mount plate of the housing to define a faceplate compartment; (f) a movable armature ring located in the faceplate compartment; (g) an extendable faceplate drawer, which is able to be received into the faceplate compartment adjacent and substantially parallel to the inner transparent cover, having a central aperture of a sufficient size to permit the shaft to extend therethrough, and having a linear passage extending radially from the central aperture toward a perimeter of the faceplate drawer; (h) the extendable rim assembly comprising the faceplate drawer attached thereto, and two flexible, resilient tabs each coupled to a different end of the extendable rim assembly for engagement with and attachment to the non-extendable rim portion; and (i) a thin, substantially flat removable face, removably received in the extendable faceplate drawer. The face may be made of flexible, resilient material having a central aperture of sufficient size to permit the shaft to extend therethrough, and having a linear passage extending radially from the central aperture toward a perimeter of the face. Aligning the central apertures and linear passages of the removable face and the extendable faceplate drawer, ensures a particular position for the removable face when inserted in the extendable faceplate drawer, which will result in optimal viewing of the removable face through both the transparent crystal and the inner transparent cover of the timepiece when the extendable faceplate drawer is inserted into the faceplate compartment.

The invention may be embodied as a horologe with a digital display comprising: (a) a housing which, along with a substantially flat mount plate, protects a horological movement, the mount plate having an aperture through which the digital display is visible; (b) a transparent crystal attached to the housing and being spaced from the mount plate for defining a faceplate compartment; (c) a movable armature ring located in the faceplate compartment; (d) a post extending from the central area of the mount plate of the housing in a substantially perpendicular direction from the plane of the housing's mount plate into, but not beyond, the plane defined by the armature ring; (e) the housing including a rim portion having an opening for accessing the faceplate compartment, the housing having a pair of coupling recesses or mortises adjacent the opening; (f) an extendable rim assembly having a pair of coupling tabs, each tab being located at opposite ends of the extendable rim portion for coupling with the recesses or mortises of the housing and substantially closing the opening; (g) an extendable faceplate drawer attached to the extendable rim assembly, which is able to be received into the faceplate compartment above the movable armature ring; (h) a removable face including a die-cut or transparent area intended to coincide with the digital display, removably received in the extendable faceplate drawer, where the removable face and the digital display are viewable through the transparent crystal.

In another embodiment of the invention with an analog display there is: (a) a housing which, along with a substantially flat mount plate, encloses a horological movement; (b) a shaft extending in a substantially perpendicular direction from the plane of the mount plate and being operationally connected to the horological movement; (c) at least one hand attached to the shaft and extending in a direction substantially parallel to the plane of the mount plate; (d) a rim extending around the periphery of the housing, the rim having an extendable rim assembly and a non-extendable rim portion; (e) an inner transparent cover and an outer transparent crystal attached to the non-extendable rim portion above the mount plate and defining an enclosed space, the crystal being disposed above the hand and the inner cover being disposed below the hand; (f) an outer rotating bezel extending around the periphery of the rim and surrounding the outer transparent crystal; (g) the inner cover spaced from the mount plate of the housing to define a segregated faceplate compartment; (h) a thin, substantially flat removable face which may be made of flexible, resilient material dimensioned to be received in the faceplate compartment and viewable through the inner transparent cover and the outer transparent crystal, having a central aperture of sufficient size to permit the shaft to extend therethrough, and having a linear passage extending radially from the central aperture toward a perimeter of the face; (i) an extendable rim assembly having an extendable rim portion comprising a sliding lock mechanism with a coupling hook for engaging and releasing the housing, and an undercase below the housing comprising a spring hinge for attaching to the non-extendable rim portion to control the movement of the housing when released from the extendable rim portion, the undercase also may provide space for storing removable faces; two watch lugs attached to the extendable rim portion, and two watch lugs attached opposite to the undercase for attaching a strap or bracelet.

Another embodiment of the invention has: (a) a housing which, along with a substantially flat mount plate, encloses a horological movement; (b) a rim extending around the periphery of the housing, the rim having an opening; (c) a transparent crystal attached to the housing and being spaced from the mount plate for defining a faceplate compartment; (d) an outer rotating bezel, having an opening, and extending around the periphery of the rim and surrounding the outer transparent crystal (to access the faceplate compartment, the outer rotating bezel may be rotated until its opening aligns with the opening in the rim); and (e) a thin, substantially flat removable face made of flexible, resilient material dimensioned to be received in the faceplate compartment and viewed through the transparent crystal. In at least one embodiment, the invention further comprises two sets of watch lugs attached to opposite sides of the rim for attaching a strap or bracelet.

The invention may also be described as a horologe comprising a horological movement, a housing, a rim extending around the housing, an outer transparent crystal attached to the rim, an inner transparent cover attached to the rim, and a removable face. The housing protects the horological movement and has a substantially flat mount plate. A portion of the rim is extendable away from the housing to reveal an opening. The inner transparent cover is positioned between the outer crystal and the mount plate of the housing and positioned apart from the housing to create a space between the inner cover and the mount plate so as to form a faceplate compartment. The removable face is adapted for insertion into the faceplate compartment. The removable face may be thin and made of a flexible, resilient material on which graphic imagery can be applied by various techniques.

In one embodiment, the horologe further comprises an undercase attached to the extendable portion of the rim. The undercase being selectively extendable away from the housing; and a hinge pivotally connecting the undercase to the rim. In another embodiment, the horologe further comprises an outer rotating bezel having an opening. The bezel may be rotated so that its opening corresponds with the opening in the housing.

In one embodiment, the horologe further comprises an outer bezel selectively attached to the non-extendable portion of the rim, at least a portion of the bezel being selectively extendable away from the housing.

In another embodiment, the horologe further comprises a outer bezel attached to the extendable portion of the rim. The outer bezel is selectively extendable away from the housing, and a hinge pivotally connects the outer bezel to the rim.

The invention may also be described as a horologe comprising, a horological movement, a housing having a substantially flat mount plate and a rim, the rim extending around the housing, an outer transparent crystal attached to the rim, an inner transparent cover attached to the rim, an extendable drawer, a removable face residing in the drawer, and an extendable rim assembly. The horologe may be embodied, for example, as a watch or a clock. The housing protects the horological movement. A portion of the rim is extendable away from the housing to reveal an opening. The inner transparent cover is positioned between the outer crystal and the mount plate of the housing and positioned apart from the housing to create a space between the inner cover and the mount plate so as to form a faceplate compartment. The extendable drawer is adapted for insertion into, and selectably extendable from, the faceplate compartment. The removable face is thin and made of a flexible, resilient material on which graphic imagery can be applied by various techniques. The extendable rim assembly, comprising the extendable rim portion, is attached to the drawer. The drawer is permitted to be selectively extended from the faceplate compartment, but not detached from the horologe. The face is permitted to be removed from the drawer and/or a different face to be inserted into the drawer.

In one embodiment, the extendable rim assembly comprises guides made of resilient, durable, yet elastic material, wherein each guide is attached to the drawer. In another embodiment, the horologe further comprises a track in which one of the guides may slide, and thereby movably attach the guide to the horologe, wherein the track resides in a space between the housing and the rim.

In one embodiment, the horologe further comprises a moveable armature ring residing in the faceplate compartment. The armature ring is positioned to counterbalance the drawer when the drawer is extended from the faceplate compartment. In another embodiment, the armature ring has a surface shaped similarly to a surface of the drawer. The surface of the armature ring may abut the surface of the drawer when the drawer resides fully in the faceplate compartment.

In one embodiment, the horologe further comprises a shaft operationally connected to the horological movement and extending through the mount plate of the housing in a direction that is substantially perpendicular to the mount plate of the housing. One or more hands may be attached to the shaft, and each hand may extend from the shaft in a direction that is substantially parallel to the mount plate of the housing. In another embodiment, the face has a tab, an aperture at its central area, and a linear passage extending substantially radially from its central area toward at least one point of the perimeter of the face. The linear passage is configured to permit passage of the shaft as the face is inserted into or removed from the faceplate compartment. The linear passage may have a circular aperture as one terminus point and a lead-in, preferably with curved edges, as another terminus point.

In one embodiment, the horologe further comprises a digital display. The digital display is viewable through the mount plate and configured to communicate a time to a person. The face may have an aperture or a transparent surface positioned to coincide with the display when the face resides fully in the faceplate compartment.

In another embodiment, the drawer has a centrally located aperture and a linear passage extending radially from the central aperture. Both the aperture and the linear passage are of a size sufficient to permit the shaft to extend therethrough. In one embodiment, the drawer has a transparent surface positioned to coincide with the digital display when the drawer resides fully in the faceplate compartment.

Other objects, advantages and salient features of the invention will become apparent from the following detailed description, which taken in conjunction with the annexed drawings, discloses embodiments of the invention.

DESCRIPTION OF THE DRAWINGS

For a fuller understanding of the nature and objects of the invention, reference should be made to the following detailed description taken in conjunction with the accompanying drawings, in which.

DETAILED DESCRIPTION OF THE INVENTION

Figure 2:
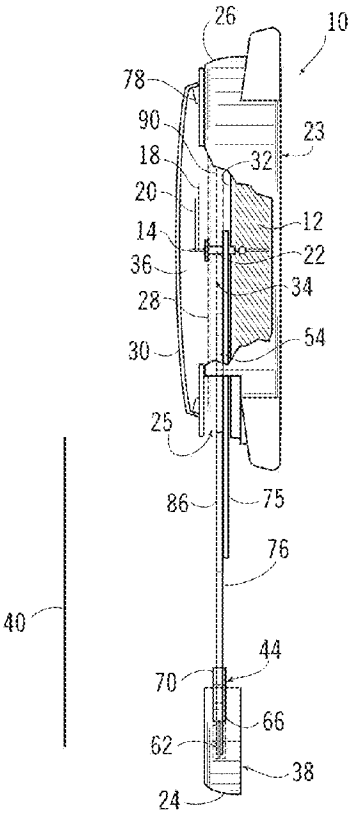
FIG. 2 is a side view in partial cross-section of the watch shown in FIG. 1.
Figure 4:
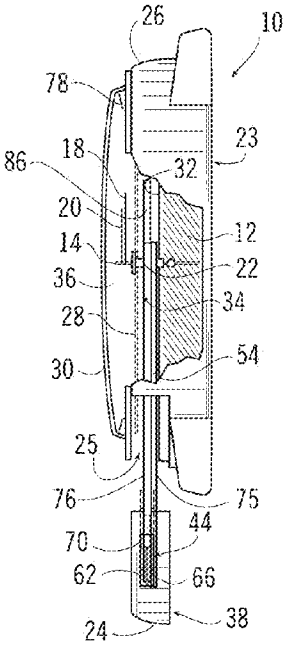
FIG. 4 is a side view in partial cross-section of the watch shown in FIG. 3.
Figure 3:
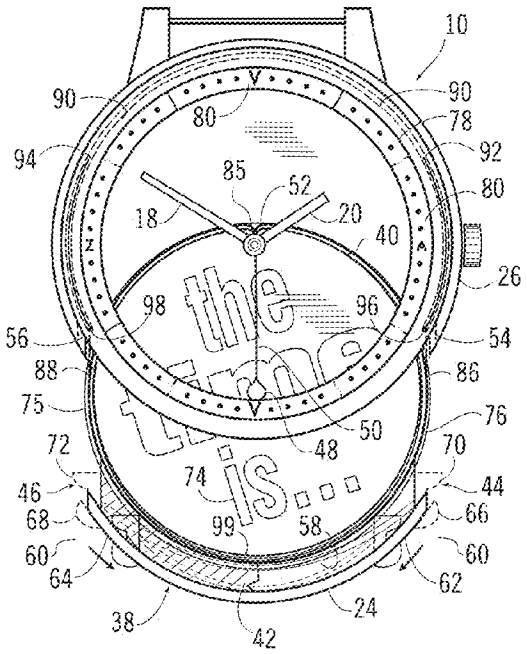
FIG. 3 is a plan view of the watch in FIG. 1 showing the face in the faceplate drawer and the faceplate drawer, as part of the extendable rim assembly, partially inserted into the faceplate compartment.
Figure 6:
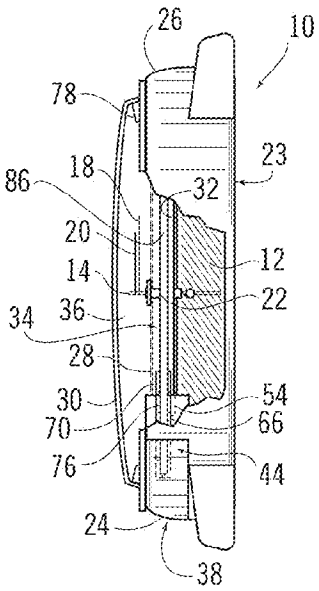
FIG. 6 is a side view in partial cross-section of the watch shown in FIG. 5.
Figure 5:
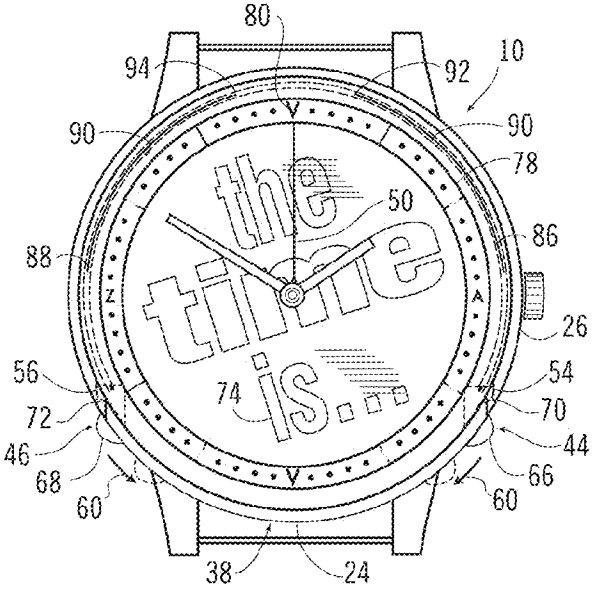
FIG. 5 is a plan view of the watch in FIG. 1 showing the face in the faceplate drawer and the faceplate drawer, as part of the extendable rim assembly, completely inserted into the faceplate compartment.

Referring now to the drawings, wherein like reference numerals refer to like elements, a first embodiment of a horologe in accordance with the present invention is shown in FIGS. 1-6 and designated generally by the numeral 10. As shown in FIGS. 2, 4, and 6, horologe 10 comprises a timepiece movement 12, which is encased and sealed. A shaft 14, which drives the minute hand 18 and the hour hand 20, extends out from the movement 12 perpendicular to the plane of the housing 23. Shaft 14 can be encased in an outer protective sleeve 22 if desired. Housing 23 extends around the periphery of movement 12. The horologe 10 may have an extendable rim portion 24 and a non-extendable rim portion 26. An inner transparent cover 28 and an outer transparent crystal 30 may be attached to the non-extendable rim portion 26 creating an outer enclosed space 36, which contains the hands 18 and 20. A segregated faceplate compartment 34 is formed by the space created by the mount plate 32 of housing 23, the non-extendable rim portion 26 and the inner transparent cover 28. The non-extendable rim portion 26 includes an opening 25 to the faceplate compartment 34, which is normally closed by the extendable rim portion 24. The outer enclosed space 36 formed by the non-extendable rim portion 26, the inner transparent cover 28 and the outer transparent crystal 30 may be sealed to protect the movement of the hands 18 and 20. Sleeve 22 can be sealed to the inner transparent cover 28 and the mount plate 32 to prevent dirt and moisture from entering the outer enclosed space 36.

Horologe 10 further comprises an extendable faceplate drawer 76, which is adapted for insertion into and selectively extendable from the faceplate compartment 34. Faceplate drawer 76 has a central aperture 82 of a size sufficient to permit the shaft 14 to extend therethrough, and a linear passage 84 extending radially from the central aperture 82 toward the perimeter of the faceplate drawer 76. The outer end 85 of the linear passage 84 is preferably curved for ease of use when sliding around shaft 14 and sleeve 22.

Extendable faceplate drawer 76 is adapted to receive a removable face 40. Face 40 may be made of a thin, substantially flat, flexible and resilient material. Face 40 may be made from a woven or non-woven synthetic material, such as polyester or polyethylene or various fibrous substances, including paper. Preferably, face 40 is made of a resilient material having a thickness sufficiently thin to be received in the extendable faceplate drawer 76 and also flexible enough to slide around the shaft 14 and sleeve 22.

Face 40 further includes a central aperture 48 at its center. Central aperture 48 is sufficient in size to extend around the periphery of the drawer's central aperture 82 so as to permit shaft 14 and sleeve 22 to extend therethrough. Face 40 also includes a linear passage 50, which extends radially from central aperture 48 toward the perimeter of face 40 so as to align with the faceplate drawer linear passage 84. Linear passage 50 is preferably very small in width and is sometimes referred to as a hairline cut, with opposing edges of the cut preferably contacting each other or nearly contacting each other, so that the face 40 appears seamless when assembled into the horologe 10. The face central aperture 48 may be round, but it is preferably curved or teardrop shaped adjacent to linear passage 50. The curved or teardrop shape of the central aperture 48 allows for easier removal of the face 40 while reducing wear. An outer end 52 of linear passage 50 is preferably curved for ease of use when sliding around the shaft 14 and the sleeve 22.

Horologe 10 may further comprise an extendable rim assembly 38, which includes the extendable rim portion 24 and a flange 42 attached to extendable rim portion 24 for attachment to extendable faceplate drawer 76. In this embodiment of the invention, extendable faceplate drawer 76 is shown fixed to a flange 42 on the extendable rim assembly 38 to form a one-piece unit. Extendable faceplate drawer 76 can be removably coupled to flange 42 by a suitable means such as for example, by snaps or a pressure-sensitive adhesive. As part of the extendable rim assembly 38, the flange 42 may comprise a means for the tabs 44 and 46 to connect to each other by a spring 58. Extendable rim assembly 38 also may include a means for engagement and attachment of the extendable rim assembly 38 to the non-extendable rim portion 26. The engagement means shown in FIGS. 1 and 3 comprises two flexible resilient tabs 44 and 46 each being attached to different ends of the extendable portion of the rim 24 for engagement with and attachment to the non-extendable portion of the rim 26. In one embodiment of the invention, the extendable faceplate drawer 76 is removably attached to the extendable rim assembly 38.

The extendable rim portion 24 and the extendable faceplate drawer 76 of the present invention are extendable from the non-extendable rim portion 26 of the horologe 10, and remain attached to the non-extendable rim portion 26 by means of faceplate drawer guides 86 and 88. Guides 86 and 88 may be made of resilient, durable, yet flexible material, such as tempered steel. Each of the extended ends of faceplate drawer guides 86 and 88 may be secured to different sides of faceplate drawer 76 by suitable means, such as for example, snaps or a pressure-sensitive adhesive. The other end of faceplate drawer guide 86 may include an affixed nub 92, and the other end of faceplate drawer guide 88 may include an affixed nub 94. Nubs 92 and 94 can be extensions of guides 86 and 88, formed by bending the material back toward itself.

Faceplate drawer guides 86 and 88 slide easily along the segregated track 90 defining a space, extending from recess 54 counterclockwise to recess 56, formed by the non-extendable portion of the rim 26 and the watch housing 23. Nubs 92 and 94, of guides 86 and 88, are not attached to housing 23. When the extendable portion of the rim 24 and the attached extendable faceplate drawer 76 are extended away from the housing 23, the faceplate drawer guides 86 and 88 also slide along track 90 in the same direction. At the point where extendable faceplate drawer 76 is fully extended from housing 23, nubs 92 and 94 of faceplate drawer guides 86 and 88 respectively, make contact with nub stoppers 96 and 98 respectively, to prevent faceplate drawer guides 86 and 88 separating from the track 90 of housing 23. Stoppers 96 and 98 may be made of resilient, durable and elastic material. Stopper 96 may be secured to track 90 adjacent to recess 54 by suitable means, such as for example, a pressure-sensitive adhesive. Stopper 98 may be secured to track 90 adjacent to recess 56 in a similar fashion. When the extendable rim portion assembly 38, including faceplate drawer 76, is inserted into the segregated faceplate compartment 34 of horologe 10, the faceplate drawer guides 86 and 88 attached to faceplate drawer 76 slide along track 90 in the same direction.

To further stabilize extendable faceplate drawer 76 so as to remain substantially parallel to the horizontal plane of mount plate 32 of housing 23 when fully extended from segregated faceplate compartment 34, the present invention may include a movable armature ring 75. The armature ring 75 may have a circumference similar to extendable faceplate drawer 76. Movable armature ring 75 may be made of a lightweight and durable material, such as titanium, and may be located in segregated faceplate compartment 34 adjacent and parallel to the mount plate 132 of the housing 123. The extendable faceplate drawer 76 may include a flexible and resilient clip 99 for engaging and disengaging movable armature ring 75. As the faceplate drawer 76 is inserted into the faceplate compartment 34, the clip 99 engages the armature ring 75, allowing both the faceplate drawer 76 and the armature ring 75 to move in unison as the insertion of the faceplate drawer 76 is completed. Having the clip 99 engage the armature ring 75 also ensures that the armature ring 75 will move in unison with the faceplate drawer 76 as the faceplate drawer 76 begins to move out of the faceplate compartment 34. While extendable faceplate drawer 76 is able to fully extend from segregated faceplate compartment 34, movable armature ring 75 is prevented from extending beyond a certain point by shaft 14 or sleeve 22. At the point the armature ring 75 reaches the shaft 14 and the faceplate drawer 76 continues to move out of the faceplate compartment 34, the clip 99 disengages from the armature ring 75. Prevented from extending any further by the shaft 14, armature ring 75 acts as a counterweight—stabilizing faceplate drawer 76 and counterbalancing its weight.

In the embodiment shown, the inner bezel 78 of housing 23 may include indicia 80 for marketing purposes. And in further embodiments, inner bezel 78 may include numbers or indicia for indicating the time in complement with hands 18 and 20 of the horologe 10. In this manner, the function of the horologe and the ability to determine the time is not disrupted by the removal of the face 40. In alternate embodiments, the numerals and symbols for indicating the time may be provided on the removable face 40.

Figure 1:
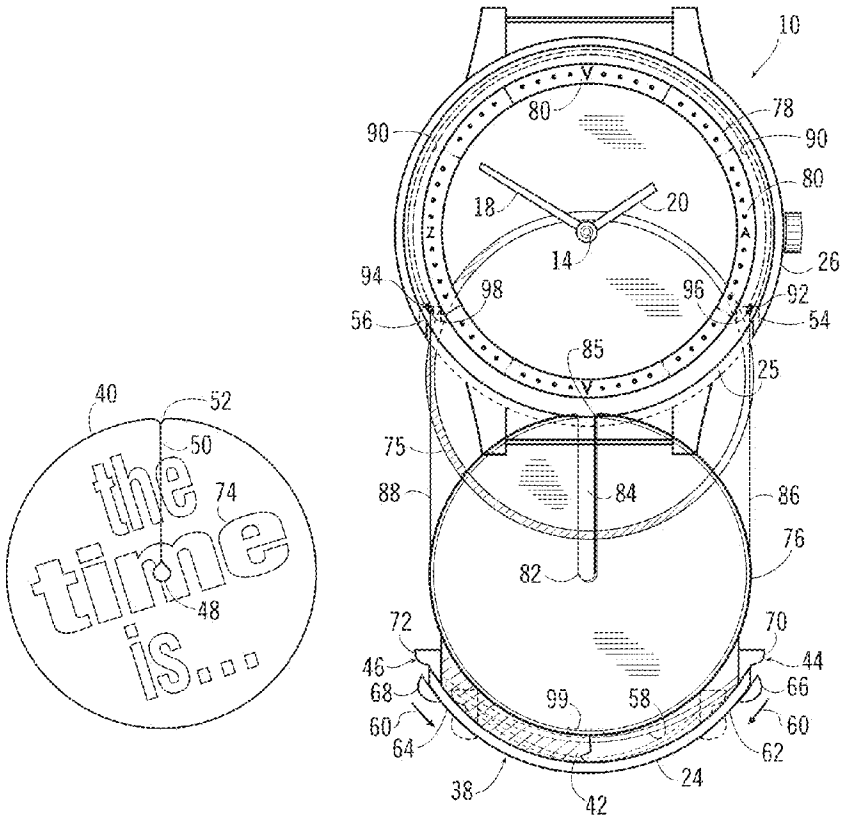
FIG. 1 is a plan view of a watch in accordance with the present invention showing the face removed from the watch and the extendable rim assembly fully extended from the faceplate compartment.

Referring to FIGS. 1 and 2, horologe 10 of the present invention may be used by first selecting a removable face 40, which the user desires to display. Face 40, with design 74 visible, is then inserted in the extended faceplate drawer 76, aligning face central aperture 48 with the drawer central aperture 82, and aligning face linear passage 50 with drawer linear passage 84 to ensure a set position for removable face 40. This set position results in ease of use when shaft 14 and sleeve 22 slide through drawer linear passage and face linear passage 50 as extendable faceplate drawer 76 is inserted into the segregated faceplate compartment 34, and slid inward as end 85 of drawer linear passage 84 and end 52 of face linear passage 50 engage shaft 14 and sleeve 22. Providing a means for a set position for removable face 40 additionally ensures optimal viewing of removable face 40 through both transparent crystal 30 and inner transparent cover 28 when the extendable faceplate drawer is fully inserted into segregated faceplate compartment 34. The flexible material of face 40 bends as it passes on either side of shaft 14. The resilient properties of the material of face 40 allow face 40 to flatten and return to its original substantially flat shape when face linear passage 50 passes beyond shaft 14 and sleeve 22 so that shaft 14 resides in face central aperture 48. Simultaneously with face linear passage 50, faceplate drawer linear passage 84 passes beyond shaft 14 and sleeve 22 so that shaft 14 and sleeve 22 resides in the drawer central aperture 82. Face linear passage 50 is preferably made sufficiently thin so that the opposing edges thereof contact or nearly contact each other when face 40 is inserted into horologe 10, so that linear passage 50 is not readily noticeable to the user. In order to lock extendable rim assembly 30 in horologe 10, the user simultaneously squeezes the two tabs 44 and 46 toward the center of extendable rim portion 24 as the faceplate drawer 76 is inserted into faceplate compartment 34 of horologe 10.

Extendable rim assembly 38 comprises tabs 44 and 46 attached to extendable rim portion 24 for movement in an unlocking and locking direction as indicated by arrows 60. The tabs 44 and 46 can be made of a flexible, resilient material. If the tabs are not sufficiently resilient themselves, they can be connected to each other or to extendable rim assembly 38 by spring 58, which may be made of a resilient material, such as a tempered steel, which spring 58 biases the tabs outwardly. Extendable rim portion 24 may include apertures 62 and 64 for receiving tabs 44 and 46, respectively, and allowing limited movement of the tabs with respect to the extendable rim portion 24 as shown in phantom lines in FIGS. 1, 3, and 5. Tabs 44 and 46 further may include actuating members 66 and 68, respectively, extending outwardly from the extendable rim portion 24 and hook members 70 and 72, respectively, for engaging mortises 54 and 56, respectively in the non-extendable rim portion 26.

By simultaneously squeezing actuating members 62 and 64, of the tabs 44 and 46 respectively, toward each other and sliding the faceplate drawer, containing face 40, through opening 25 into the faceplate compartment 34, at which point actuating members 62 and 64 are released, and the hook members 70 and 72 (on the tabs 44 and 46, respectively) engage mortises 54 and 56 in the non-extendable rim portion 26. Upon insertion of faceplate drawer 76, containing face 40, in faceplate compartment 34, the resilient property of face 40 allows it to appear nearly seamless in the inserted and locked position shown in FIGS. 5 and 6. In order to remove face 40 and interchange it with a different face, the user squeezes the tabs 44 and 46 together and withdraws extendable rim assembly 38 and faceplate drawer 76, containing face 40 from faceplate compartment 34. Face 40 is removed from faceplate drawer 76, another removable and interchangeable face 40 is selected and placed in faceplate drawer 76, and the insertion process is repeated.

Thus, it can be seen that the horologe of the present invention has a number of advantages. Sliding the faceplate drawer 76 in or out in order to change the face of the horologe may be accomplished in one motion using only one hand thereby making it quick and easy to remove or insert a desired removable face 40. Because the tabs 44 and 46 are part of the extendable rim assembly 38, a single movement allows the user to insert or withdraw the faceplate drawer 76. Moreover, the invention may be ergonomically designed, and does not create undue stress on the union between the extendable and non-extendable portions of the rim. It is also advantageous that the extendable rim assembly 38, including the faceplate drawer 76 and the face 40, when contained in the faceplate compartment 34, may be independent of the timekeeping functions of the horologe. The segregated faceplate compartment 34 ensures that the removable and interchangeable face 40 inserted in the faceplate drawer 76 will not interfere with either the watch movement 12 or the movement of the horologe hands 18 and 20. In addition, the protective sleeve 22 on shaft 14 ensures that the interchangeable face 40 will not interfere with the rotation of the shaft 14.

The operational integrity of the horologe may be further protected from contaminating dirt, dust, grime, and moisture: (a) by the outer enclosed space 36 being sealed by the following components: the inner transparent cover 28, the non-extendable rim 26, and the outer transparent crystal 30; and (b) by the outer protective sleeve 22, which may encase shaft 14, being sealed to the outer enclosed space 36 and the mount plate 32 of the housing 23, which encases the watch movement 12.

Linear passage 50 in face 40 may create a near-seamless image when face 40 is placed in faceplate drawer 76 and faceplate drawer 76 is inserted into faceplate compartment 34 in the locked position, giving the appearance of a timepiece with a permanent face. Finally, changing of the faces 40 does not affect the primary function of the timepiece, namely to tell time.

A variation of the first embodiment may have a digital display rather than an analog display, including a removable face substantially similar to the removable face 140 of the second embodiment described below.

In a second embodiment of the invention, illustrated in FIGS. 7-12, horologe 110 is a watch with a digital display. Some components may be substantially similar to the horologe 10 of the embodiment of FIGS. 1-6, and like elements are identified by the same reference numbers of the 100 series.

In this embodiment, horologe 110 has a timepiece movement 112 with a digital display 180. In the embodiment illustrated in FIG. 7, digital display 180 is visible through an aperture in mount plate 132. In alternate embodiments, the digital display 180 may be viewed in different locations through a corresponding aperture in mount plate 132. Movement 112 may also include a pair of actuating buttons 182 and 183 for setting the movement 112 in the manner known for conventional timepieces with a digital display.

Housing 123, extends around the periphery of the movement 112, and along with mount plate 132, protects the movement 112 The horologe 110 comprises an extendable rim portion 124 and a non-extendable rim portion 126. An inner transparent cover 128 and an outer transparent crystal 130 may be attached to the non-extendable rim portion 126. The mount plate 132, the non-extendable rim portion 126, and the inner transparent cover 128 form a segregated faceplate compartment 134. Non-extendable rim portion 126 includes an opening 125 to the faceplate compartment 134, which is normally covered by the extendable rim portion 124.

Horologe 110 may further comprise a removable face 140, which is dimensioned for insertion into and removable from the faceplate compartment 134. Face 140 may include a transparent window 184 (which may comprise a simple rectangular die-cut opening or a layer of transparent plastic material through which the display 180 may be viewed) positioned so that the display 180 may be viewed when face 140 is completely inserted into faceplate compartment 134. Face 140 may further include a desired indicia 174 for displaying through crystal 130. In other embodiments, removable face 140 may be a transparent material, which can include suitable indicia printed thereon. In this manner, the die-cut window opening can be eliminated. Face 140 may have a printable design area 141 on which a design may be printed, and a visible design area 143 where the design may be visible through crystal 130. The indicia 174 may be located in the design area 141.

The horologe 110 may further comprise an extendable rim assembly 138, which includes the extendable rim portion 124 and the undercase 176. In this embodiment of the invention, extendable rim portion 124 and undercase 176 form a one-piece unit. Undercase 176, positioned below and adjacent to the housing 123, comprises a spring hinge 199 attachable to the non-extendable rim portion 126 to control the movement of the housing 123 when released from extendable rim portion 124. The undercase 176 also comprises space 177 for storing additional removable faces.

Other embodiments may not include the inner transparent cover 128, resulting in the faceplate compartment being defined by the non-extendable rim portion 126, the transparent crystal 130 and the mount plate 132.

Figure 7:
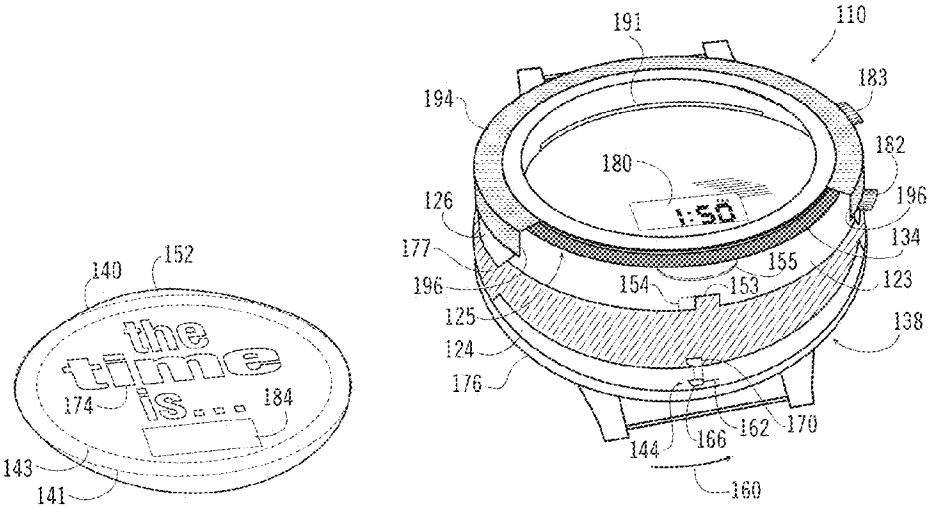
FIG. 7 is a perspective view of a digital watch in accordance with a second embodiment of the invention showing the face removed from the watch, the rotating bezel, and the extendable rim assembly in the open and unlocked position revealing the opening of the faceplate compartment.
Figure 8:
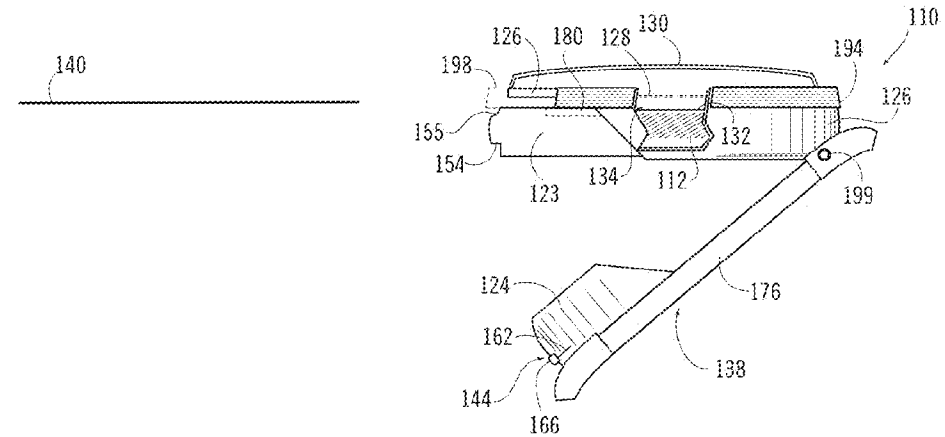
FIG. 8 is a side view in partial cross-section of the watch shown in FIG. 7.
Figure 9:
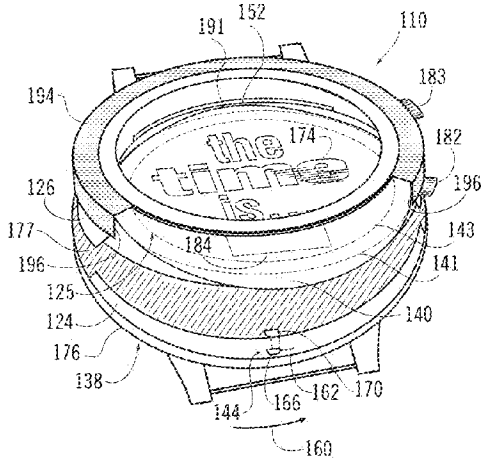
FIG. 9 is a perspective view of the digital watch in FIG. 7 showing the rotating bezel and the extendable rim assembly in the open and unlocked position and the face in the faceplate compartment.
Figure 10:
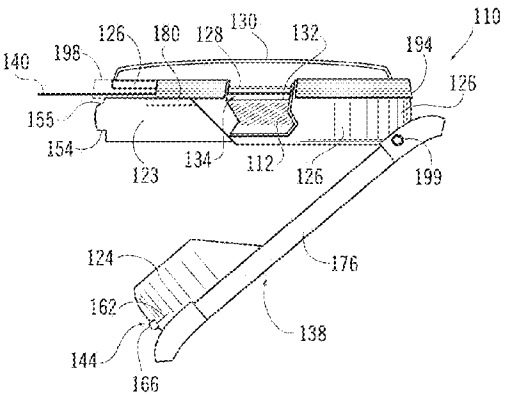
FIG. 10 is a side view in partial cross-section of the watch shown in FIG. 9.
Figure 11:
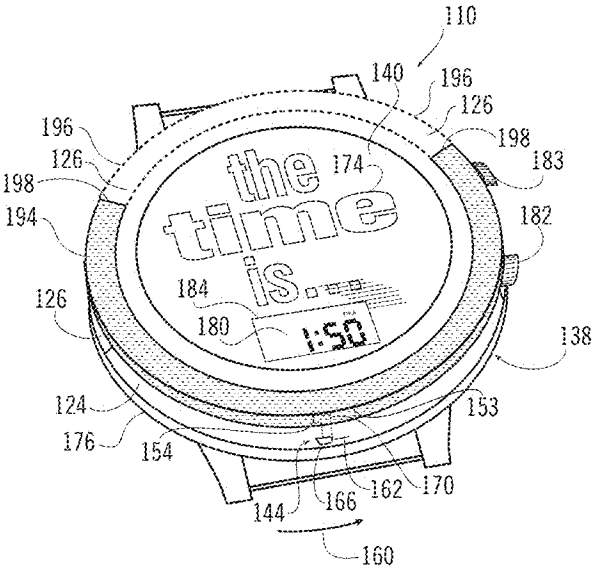
FIG. 11 is a perspective view of the digital watch in FIG. 7 showing the face in the faceplate drawer and the rotating bezel and the extendable rim assembly in the closed and locked position.
Figure 12:
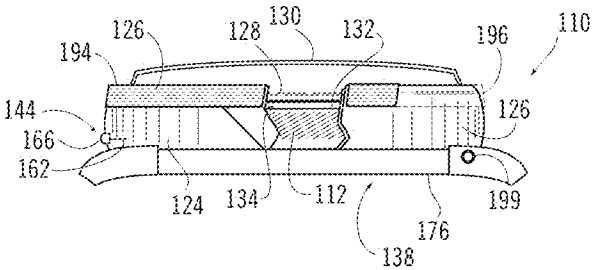
FIG. 12 is a side view in partial cross-section of the watch shown in FIG. 11.
Figure 13:
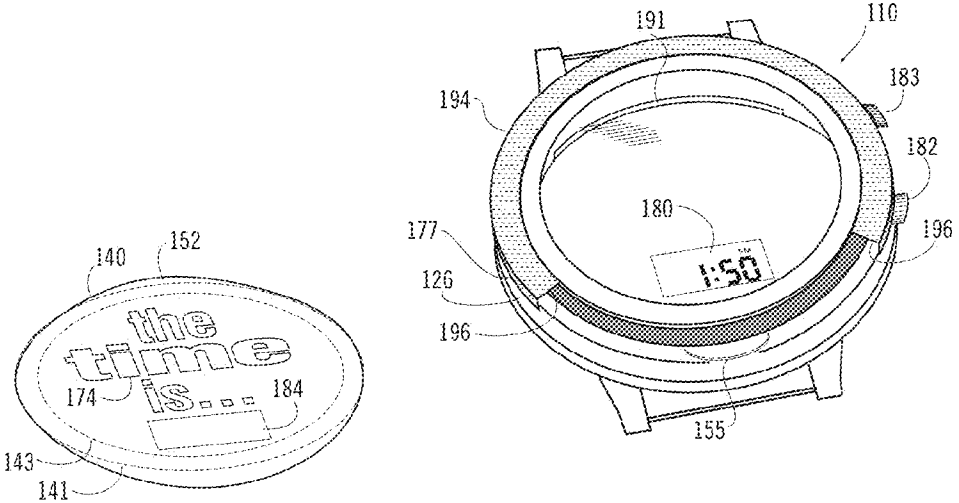
FIG. 13 is a perspective view of a digital watch in accordance with a modification of the second embodiment of the invention showing the face removed from the watch, the rotating bezel in the open and unlocked position revealing the opening of the faceplate compartment.
Figure 14:
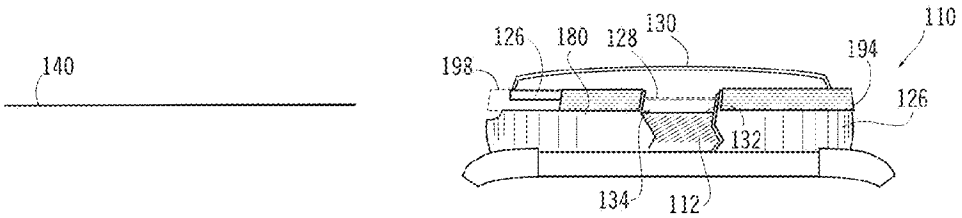
FIG. 14 is a side view in partial cross-section of the watch shown in FIG. 13.
Figure 15:
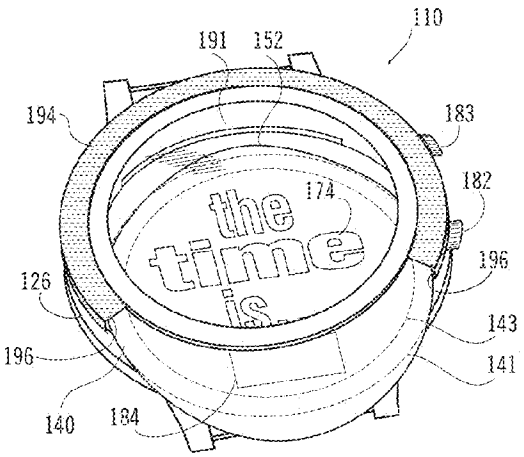
FIG. 15 is a perspective view of the digital watch in FIG. 13 showing the rotating bezel in the open and unlocked position and the face in the faceplate compartment.
Figure 16:
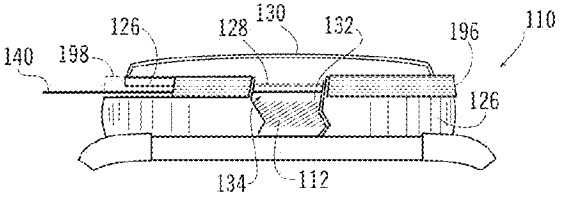
FIG. 16 is a side view in partial cross-section of the watch shown in FIG. 15.
Figure 17:
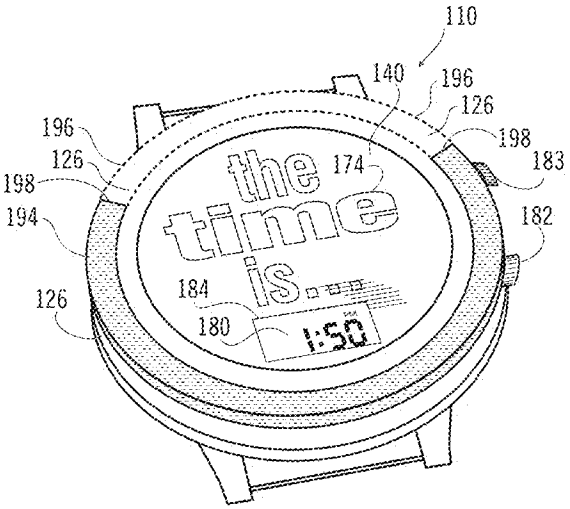
FIG. 17 is a perspective view of the digital watch in FIG. 13 showing the face in the faceplate drawer and the rotating bezel in the closed and locked position.
Figure 18:
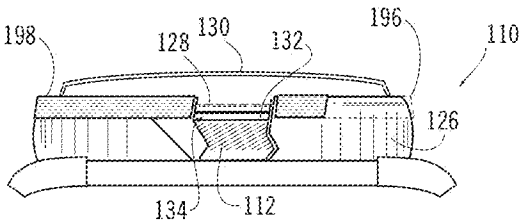
FIG. 18 is a side view in partial cross-section of the watch shown in FIG. 17.
Figure 19:
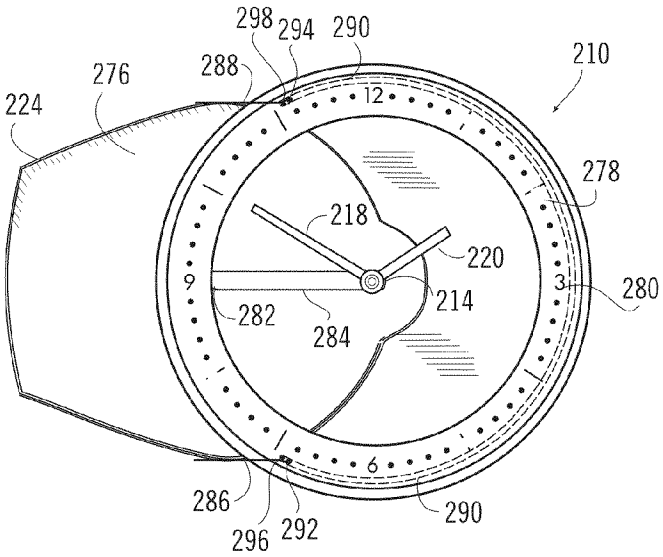
FIG. 19 is a plan view of a clock comprising a third embodiment of the invention, showing the face removed from the clock and the extendable rim assembly fully extended from the faceplate compartment.
Figure 20:
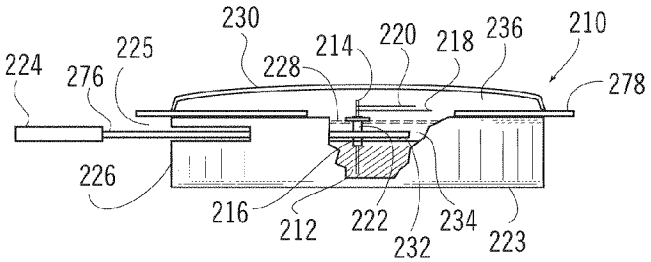
FIG. 20 is a side view in partial cross-section of the clock and face in FIG. 19.
Figure 20:
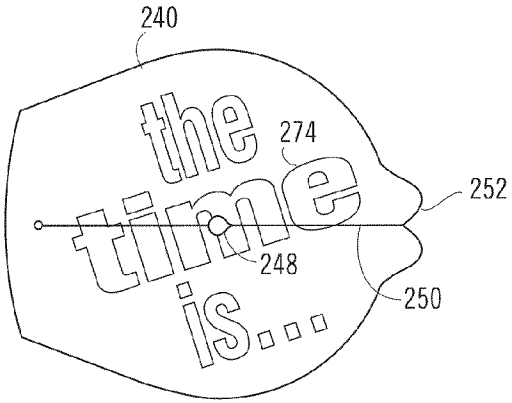
Figure 20:
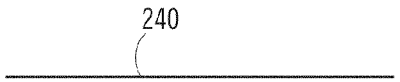
Figure 21:
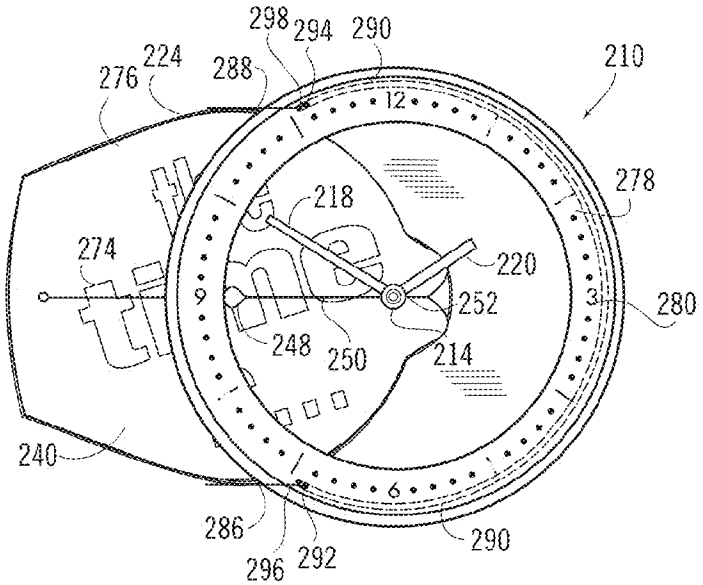
FIG. 21 is a plan view of the clock in FIG. 19 showing the face in the faceplate drawer and the faceplate drawer, as part of the extendable rim assembly, partially inserted into the faceplate compartment.
Figure 22:
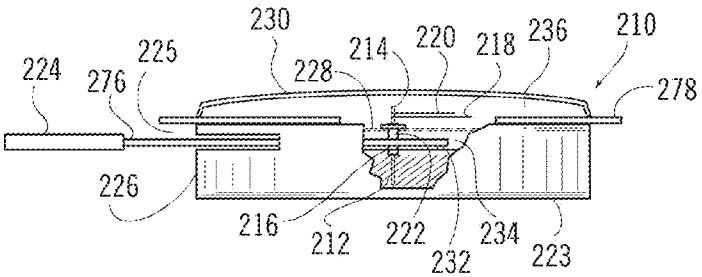
FIG. 22 is a side view in partial cross-section of the clock in FIG. 21.
Figure 23:
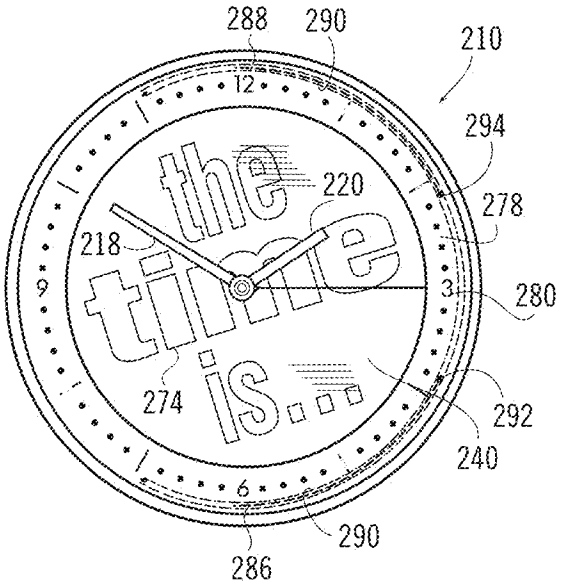
FIG. 23 is a plan view of the clock in FIG. 19 showing the face in the faceplate drawer and the faceplate drawer, as part of the extendable rim assembly, completely inserted into the faceplate compartment.
Figure 24:
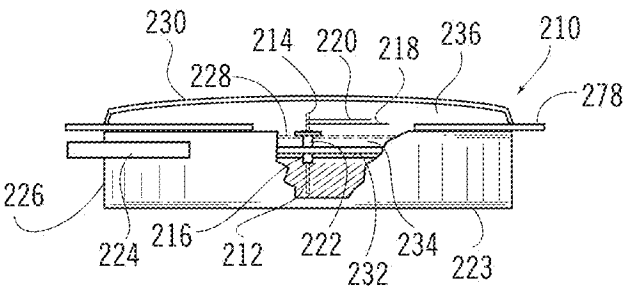
FIG. 24 is a side view in partial cross-section of the clock in FIG. 23.

In the embodiment shown in FIGS. 7-12, there is an outer rotating bezel 194, above the non-extendable rim portion 126, surrounding the outer transparent crystal 130. Referring to FIGS. 7 and 8, horologe 110 of the present invention may be used by first selecting a removable face 140. The user rotates outer bezel 194 to the open and unlocked position 196 to reveal opening 125. The user slides tab 144 of the extendable rim assembly 138 in the direction of the arrow 160 disengaging hook member 170 from mortise 154 and removing hook member 170 through recess 153, thereby releasing housing 123 from extendable rim assembly 138. Rim assembly 138 is biased to move relative to housing 123 by means of spring hinge 199 attached to the non-extendable rim portion 132 and the undercase 176. Referring to FIGS. 7 and 8, opening 125 is revealed, allowing the user to easily slide face 140 into faceplate compartment 134. Non-extendable rim portion 126 may include a docking mortise 191 to facilitate a docking area for the lead-in 152 of faceplate 140, and act to further secure faceplate 140 in a set position in faceplate compartment 134. With face 140 correctly and completely inserted into faceplate compartment 134, housing 123 is reconnected and locked to extendable rim assembly 138 by means of tab 144 with hook member 170 entering recess 153 and engaging mortise 154. Then, outer bezel 194 may be rotated to the closed and locked position 198.

In order to remove face 140 and interchange it with a different removable face, the user simply repeats the process. Specifically, the user may rotate outer bezel 194 to the open and unlocked position 196, tab 144 of extendable rim assembly 138 slides, disengaging hook member 170 from mortise 154 and removing it from recess 153, thereby releasing housing 123, which tilts upward away from extendable rim assembly 138. The outer edge of face 140 (in faceplate compartment 134) is revealed at the opening 125. As shown in FIGS. 7, 8, 10 and 12, the mount plate 132 of housing 123 may include a concave finger groove 155 at opening 125 allowing the user to grip the edge of face 140 and easily remove it from faceplate compartment 134. Another removable and interchangeable face may be selected and inserted into faceplate compartment 134 (see FIGS. 9 and 10). The housing 123 maybe reconnected and locked to the extendable rim assembly 138 (see FIGS. 11 and 12) and the outer bezel 194 may be rotated to the closed position 198.

As with the previous embodiment of the present invention this embodiment may have a number of advantages. For example, the horologe 110 depicted in FIGS. 7-12 has a small number of moving parts and has a sturdy design and construction. The complete action of removing and interchanging faces may be completed quickly, without removing the horologe 110 from the user's wrist. Therefore, it is quick and easy to remove or insert a desired removable face. When the locking mechanism defined by tab 144 is part of the extendable rim assembly 138, a single movement allows the user to release the watch housing 123 for quick and easy removal or insertion of a removable face 140.

A variation of the second embodiment (described above and depicted in FIGS. 7-12) may have an analog display rather than an digital display, including a removable face substantially similar to the removable face 40 of the first embodiment described earlier and depicted in FIGS. 1-6.

A modification of the second embodiment (described above and depicted in FIGS. 7-12) with either an analog or a digital display, could eliminate the extendable rim assembly 138 of the second embodiment, including undercase 176. This modification (See FIGS. 13-18), may comprise the rotating bezel 194 as the extendable rim portion in the open and unlocked position.

In the third embodiment of the invention, illustrated in FIGS. 19-24, the horologe 210 is a clock with an analog display. Many components may be similar to those described in conjunction with the horologe 10. In FIGS. 19-24, similar components from the first embodiment are identified by the same reference numbers of the 200 series. The horologe 210 may have a clock movement 212 enclosed in housing 223 with a shaft 214 extending outwardly through mount plate 232. The horologe 210 may comprise a rim portion 226. Attached to the rim portion 226 may be an outer transparent crystal 230 and an inner transparent cover 228 defining an outer enclosed space 236. The shaft 214 extends through an opening 216 in inner transparent cover 228 into the outer enclosed space 236. The minute hand 218 and the hour hand 220 may be attached to the shaft 214 in a conventional manner. An outer protective sleeve 222 surrounds shaft 214 to protect the shaft from interference when inserting and removing the face 240. Preferably the sleeve 222 is sealed to the inner transparent cover 228 and the mount plate 232 to prevent moisture and dirt from entering the outer enclosed space 236.

Mount plate 232, the rim portion 226, and the inner transparent cover 228 may form the segregated faceplate compartment 234. The rim portion 226 includes an opening 225 to the faceplate compartment 234, which is normally closed by the rim portion 224.

Horologe 210 further comprises an extendable faceplate drawer 276, which is adapted for insertion into and selectively extendable from the faceplate compartment 234. Faceplate drawer 276 has a central aperture 282 of a size sufficient to permit the shaft 214 and sleeve 222 to extend therethrough, and a linear passage 284 extending radially from the central aperture 282 toward the perimeter of the faceplate drawer 276.

Extendable faceplate drawer 276 is adapted to receive a removable face 240. Face 240 may be made of a thin, substantially flat, flexible and resilient material. As in the previous embodiments, face 240 may be made from a woven or non-woven synthetic material, such as polyester or polyethylene or various fibrous substances, including paper. Preferably, face 240 is made of a resilient material having a thickness sufficiently thin to be received in extendable faceplate drawer 276 and also flexible enough to slide around shaft 214 or sleeve 222.

Face 240 further includes an aperture 248 at its center. Face central aperture 248 is sufficient in size to extend around the periphery of drawer central aperture 282 so as to permit shaft 214 and sleeve 222 to extend therethrough. Face 240 also includes a linear passage 250, which extends radially from central aperture 248 toward at least one point of the perimeter of face 240 so as to align with the linear passage 284 of faceplate drawer 276. Linear passage 250 is preferably very small in width, and is sometimes referred to as a hairline cut. Opposing edges of the cut preferably contact each other or nearly contact each other, so that face 240 appears nearly seamless when fully inserted into horologe 210. Central aperture 248 may be round, but it is preferably curved or teardrop shaped adjacent to linear passage 250. The outer end of linear passage 250 may include a lead-in 252, preferably curved for ease of use when sliding around shaft 214 and sleeve 222. Rim portion 226 may include a mortise, not shown, as part of the faceplate compartment 234 to facilitate a docking area for the lead-in 252 of faceplate 240, and act to further secure faceplate 240 in a set position in faceplate compartment 234.

The extendable faceplate drawer 276 of the present invention is extendable from the rim portion 226 of horologe 210, and remains attached to the rim portion 226 by means of faceplate drawer guides 286 and 288. Guides 286 and 288 may be made of resilient, durable, yet flexible material, such as tempered steel. Each of the extended ends of faceplate drawer guides 286 and 288 may be secured to different sides of faceplate drawer 276 as shown in FIGS. 19-24 by suitable means, such as for example, snaps or a pressure-sensitive adhesive. The other end of faceplate drawer guide 286 may include an affixed nub 292, and the other end of faceplate drawer guide 288 may include an affixed nub 294. Nubs 292 and 294 can be extensions of guides 286 and 288, formed by bending the resilient, durable and flexible material from which each of the guides is made back on itself.

Faceplate drawer guides 286 and 288 slide easily along the segregated track 290 defining a space between the rim 226 and the clock housing 223. Nubs 292 and 294 are not attached to housing 223. When faceplate drawer 276 is extended away from the rim portion 226 and sliding it away from the opening 225 of the rim portion 226, the faceplate drawer guides 286 and 288 also slide along track 290 in the same direction. At the point where extendable faceplate drawer 276 has reached its maximum extension from the rim portion 226, nubs 292 and 294 of faceplate drawer guides 286 and 288 respectively, make contact with nub stoppers 296 and 298 respectively, to prevent faceplate drawer guides 286 and 288 separating from track 290 of housing 223. Stoppers 296 and 298 may be made of resilient, durable and flexible material. Stopper 296 may be secured to track 290 by a suitable means such as for example, a pressure-sensitive adhesive. Stopper 298 may be secured to track 290 in a similar fashion. When the faceplate drawer 276 is inserted into the segregated faceplate compartment 234 and slid toward the opening 225 of the rim portion 226, the faceplate drawer guides 286 and 288 attached to faceplate drawer 276 slide along track 290 in, generally, the same direction as faceplate drawer 276 (for example, the drawer 276 slides to the right in FIG. 21).

To further stabilize extendable faceplate drawer 276 so as to remain substantially parallel to the plane of mount plate 232 of housing 223, faceplate drawer 276 may be prevented from extending beyond a certain point by shaft 214 or sleeve 222.

In the embodiment shown in FIGS. 19-24, an outer bezel 278 may be attached to the periphery of clock 210, and may include suitable indicia, such as numbers 280.

A variation of the third embodiment (described above and depicted in FIGS. 19-24) may have a digital display rather than an analog display. In such an embodiment, a removable face may be configured whereby the digital display may be visible when the face is completely inserted in the faceplate compartment 234.

Figure 25:
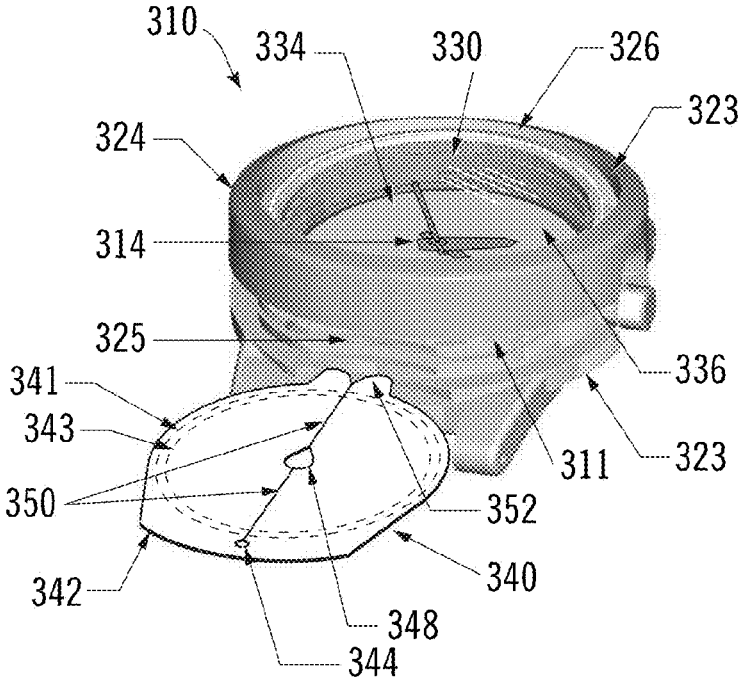
FIG. 25 is a perspective view of a watch with an analog display comprising a fourth embodiment of the invention, showing the face removed from the watch, and the outer bezel in the open, unlocked position revealing the opening of the faceplate compartment.
Figure 26:
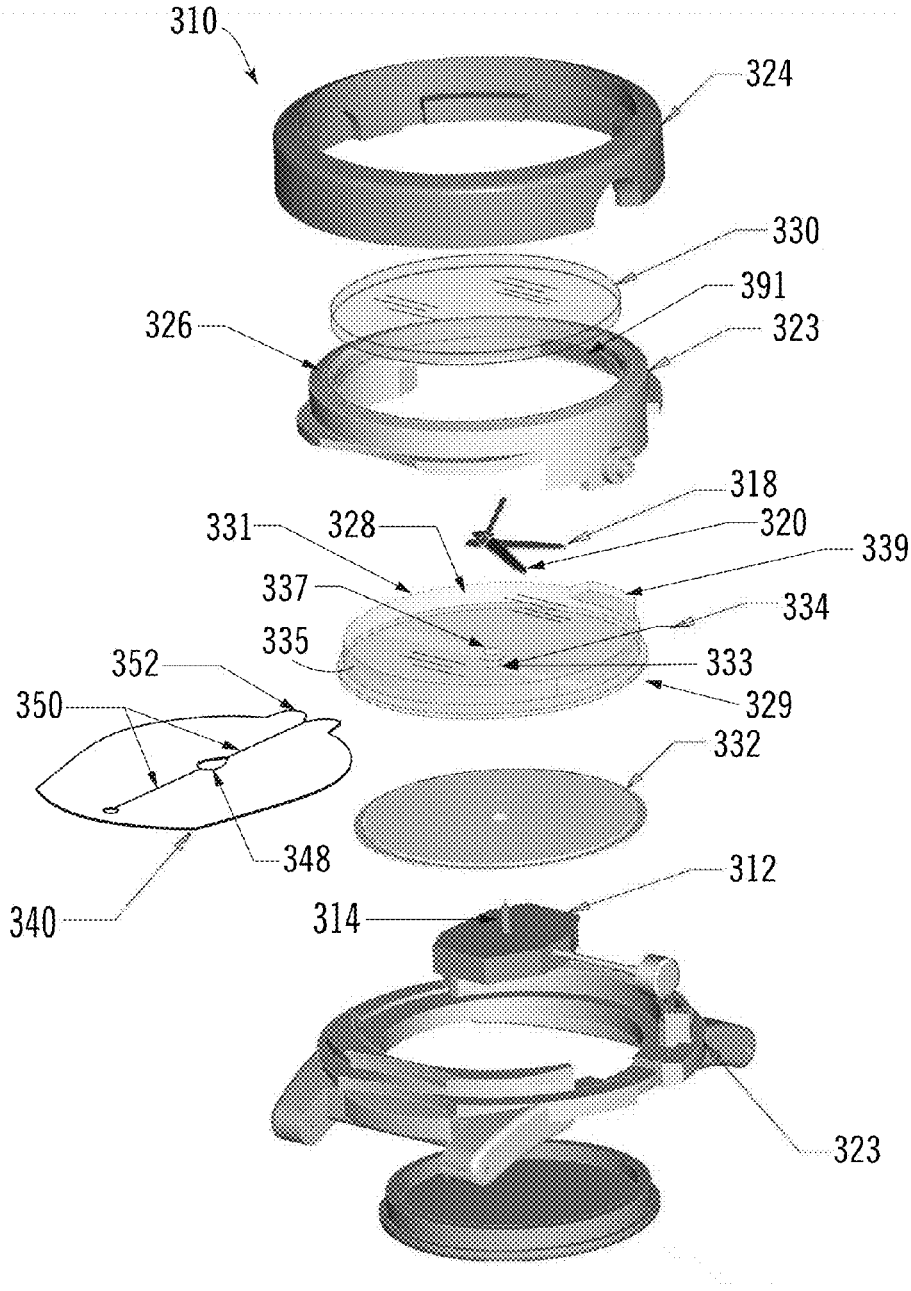
FIG. 26 is an exploded view of the watch in FIG. 25.
Figure 27:
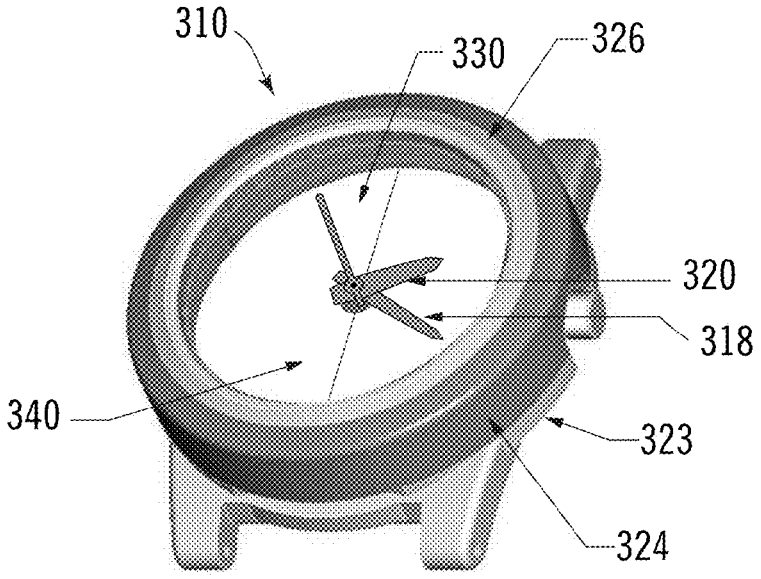
FIG. 27 is a perspective view of the watch in FIG. 25 showing the face inserted into the faceplate compartment and the outer bezel in the closed and locked position.

In a fourth embodiment of the invention, illustrated in FIGS. 25-27, horologe 310 is a watch with an analog display, and comprises a movement 312, which may be encased and sealed in housing 323, and mounted to a substantially flat mount plate 332. A shaft 314, which drives hands 318 and 320, extends from the movement 312 in a direction substantially perpendicular to the plane of the mount plate 332 through which it extends. Shaft 314 may be encased in an outer protective sleeve 322 if desired. The housing 323 comprises a rim 326, which extends around its periphery. An outer transparent crystal 330, made of a material typically used in timepieces, may be attached to the rim 326 above hands 318 and 320.

A separate transparent inner cover, parallel to the mount plate 332, may be attached to the rim 326 beneath hands 318 and 320 creating a space with the mount plate 332 and the housing 323 to form a faceplate compartment. Such a cover was described with respect to the embodiment depicted in FIGS. 1-6. However, preferably, horologe 310 would comprise a segregated, self-contained faceplate compartment 334, including a transparent cover 328, which would negate the need for a separate inner cover.

The faceplate compartment 334 is self-contained and may reside between the mount plate 332 and hands 318 and 320, and horizontally within the periphery of rim 326. In addition to transparent cover 328, the faceplate compartment 334 may include a base 329 and a rim 331, which forms the periphery of the faceplate compartment 334. To prevent interference with the proper rotation of shaft 314, self-contained faceplate compartment 334 also may comprise a protective sleeve 322 through which shaft 314 extends to enclosed space 336 (formed by rim 326, transparent cover 328 and outer transparent crystal 330). Attached to the shaft 314 are hands 318 and 320. Central apertures 333 and 337—both having similar dimensions and aligning with each other at opposite ends of sleeve 322—may be located at the base 329 and the transparent cover 328, respectively. The enclosed space 336 may be sealed to ensure unimpeded rotation of the hands 318 and 320. Further, sleeve 322 may be sealed to the transparent cover 328 and the mount plate 332 to prevent dirt and moisture from entering enclosed space 336.

The horologe 310 may further comprise an outer bezel 324 affixed to the housing 323, and surrounding the periphery of the rim 326. The rim 326 may include an opening 325 for alignment with opening 335 of the self-contained faceplate compartment 334. The outer bezel may be positioned so that when moved upward to an open and unlocked position (see FIG. 25), it reveals openings 325 and 335. When extended downward to a closed and locked position (see FIG. 27), the outer bezel 324 covers the opening 325 essentially closing (and, in some embodiments, locking) the faceplate compartment 334.

Horologe 310 may further comprise a removable face 340, which is adapted for insertion into and removal from the faceplate compartment 334. Face 340 may have a larger printable design area 341, on which a design can be printed, and a smaller visible design area 343, where the design may be visible through the crystal 330. Face 340 may be made of a thin, substantially flat, flexible and resilient material. As with the previous embodiments, face 340 may be made from a woven or non-woven synthetic material, such as polyester or polyethylene or various fibrous substances, including paper. Preferably, face 340 is made of a resilient material having a thickness sufficiently thin to be received in faceplate compartment 334 and also flexible enough to slide around shaft 314 or sleeve 322.

Face 340 may include a tab 342 by which the face 340 can be held (e.g. by fingers or a tool) as it is inserted into or removed from the faceplate compartment 334. To facilitate ease of insertion and removal of the face 340, an aperture 348 and a linear passage 350 may be included. Aperture 348 in the central area of face 340 may be sufficient in size to permit face 340 to extend around shaft 314 or sleeve 322 as face 340 is inserted into or removed from faceplate compartment 334. Central aperture 348 may be round, but is preferably curved or teardrop shaped opposite tab 342. The linear passage 350 may extend radially from central aperture 348 toward opposite ends of the perimeter of the face 340. Linear passage 350 is preferably very narrow in width and is sometimes referred to as a hairline cut. Opposing edges of the linear passage 350 are preferably contacting each other or nearly contacting each other, so that face 340 appears nearly seamless when fully inserted into horologe 310.

Face 340 may include two additional features with which to facilitate the quick, easy, and smooth insertion of faceplate 340 in faceplate compartment 334. One feature is circular aperture 344 of tab 342 as one terminus point for linear passage 350, so as to allow the opposing sides of linear passage 350 to remain substantially flat as face 340 is inserted into or removed from faceplate compartment 334. The other feature is lead-in 352 located at the other end of linear passage 350 opposite tab 342. As in previous embodiments, and shown in FIG. 26, the opposing edges of lead-in 352 are preferably curved for ease of use when sliding around shaft 314 or sleeve 322. The recess area 339 of faceplate compartment 334 is shaped to receive and secure lead-in 352 in a set position until face 340 is removed from horologe 310. Recess area 339 of faceplate compartment 334 is coupled with mortise 391 in rim 326 for this purpose.

Referring to FIGS. 25-27, horologe 310 of the present invention may be used by first selecting a removable face 340, which the user desires to display. The user moves the outer bezel 324 upward to the open and unlocked position (see FIG. 19) revealing openings 325 and 335. Then, holding tab 342, the user slides face 340 into faceplate compartment 334. The operation is quick and easy because of the unique and practical design of face 340—opposing edges of lead-in 352 preferably curved for ease of use when sliding around shaft 314 or sleeve 322 so that the opposing edges of linear passage 350 easily separate and spread apart when sliding around shaft 314 or sleeve 322. Because of circular aperture 344, face 340 remains substantially flat as it enters faceplate compartment 334. With face 340 correctly and completely inserted and secured in place in faceplate compartment 334, the user extends the outer bezel 324 downward to the closed and locked position, covering the opening 325 and essentially closing and locking the faceplate compartment 334 (see FIG. 27).

In order to remove face 340 and interchange it with a different removable face, the user simply repeats the process. Specifically, the user may move the outer bezel 324 to the open and unlocked position (see FIG. 25), thereby revealing tab 342 of faceplate 340 at the opening 325. The user grips tab 342 and quickly and easily slides face 340 out of faceplate compartment 334. Another removable and interchangeable face may be selected and inserted into faceplate compartment 334. The outer bezel 324 is extended downward to the closed and locked position, covering the opening 325 and essentially closing and locking the faceplate compartment 334 (see FIG. 27).

This fourth embodiment shares the advantages of the previous embodiments.

A variation of the fourth embodiment (described above and depicted in FIGS. 25-27) may have a digital display rather than an analog display, including a removable face substantially similar to the removable face 140 of the second embodiment described earlier.

A modification of the fourth embodiment (described above and depicted in FIGS. 25-28) with either an analog or a digital display, horologe 410 may comprise an outer bezel 424 surrounding the periphery of the rim 426, and affixed to the housing 423 by means of spring hinge 499, similar to the hinge in the second embodiment (described above and depicted in FIGS. 8, 10, and 12).

Figure 28:
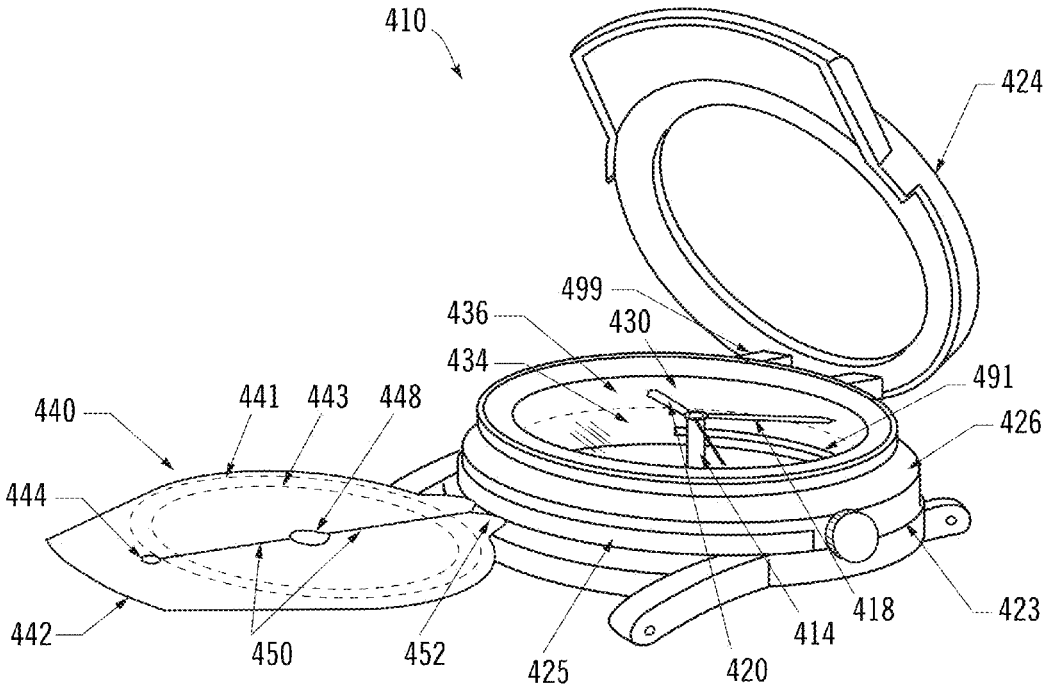
FIG. 28 is a perspective view of a watch with an analog display comprising a fifth embodiment of the invention, showing the face removed from the watch, and the outer bezel in the open, unlocked position revealing the opening of the faceplate compartment.
Figure 29:
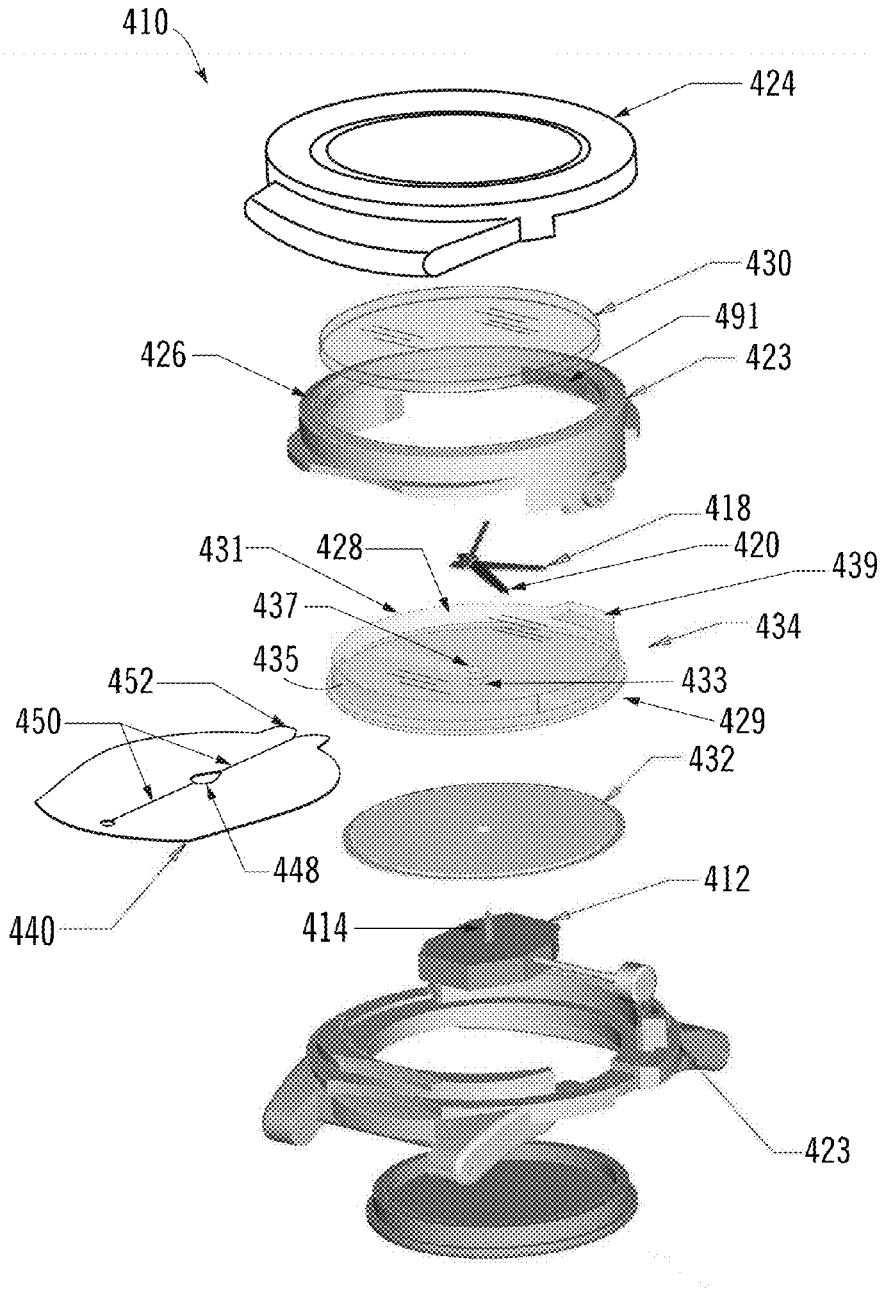
FIG. 29 is an exploded view of the watch in FIG. 28.
Figure 30:
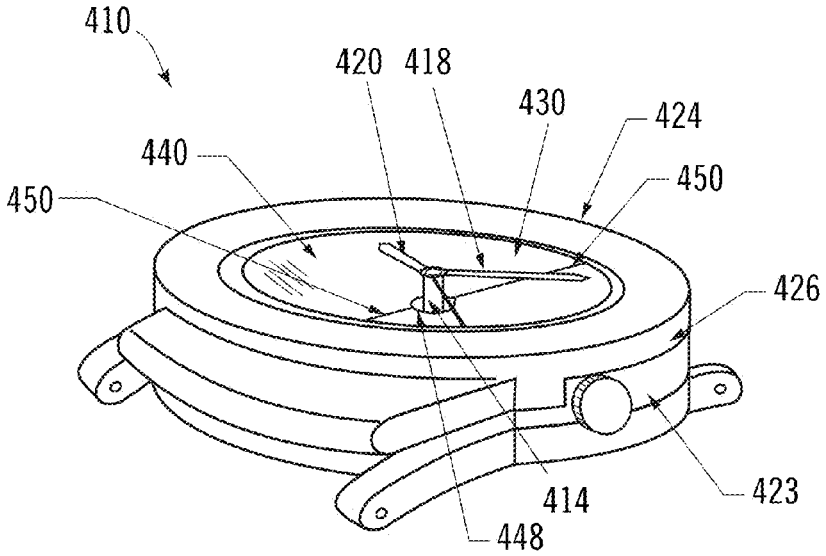
FIG. 30 is a perspective view of the watch in FIG. 28 showing the face inserted into the faceplate compartment and the outer bezel in the closed and locked position.

In this modification of the fourth embodiment of the invention, illustrated in FIGS. 28-30, horologe 410 is a watch with an analog display. This modification is substantially similar to horologe 310 of the fourth embodiment depicted in FIGS. 25-27, and like elements are identified by the same reference numbers of the 400 series.

Horologe 410 comprises a movement 412, which may be encased and sealed in housing 423, and mounted to a substantially flat mount plate 432. A shaft 414, which drives hands 418 and 420, extends from the movement 412 in a direction substantially perpendicular to the plane of the mount plate 432 through which it extends. Shaft 414 may be encased in an outer protective sleeve 422 if desired. The housing 423 comprises a rim 426, which extends around its periphery. An outer transparent crystal 430, made of a material typically used in timepieces, may be attached to the rim 426 above hands 418 and 420.

A separate transparent inner cover, parallel to the mount plate 432, may be attached to the rim 426 beneath hands 418 and 420 creating a space with the mount plate 432 and the housing 423 to form a faceplate compartment. However, preferably, horologe 410 would comprise a segregated, self-contained faceplate compartment 434, including a transparent cover 428, which would negate the need for a separate inner cover.

The self-contained faceplate compartment 434 may reside between the mount plate 432 and hands 418 and 420, and within the periphery of rim 426. In addition to transparent cover 428, the faceplate compartment 434 may include a base 429, and a rim 431, which forms the periphery of the faceplate compartment 434. To prevent interference with the proper rotation of shaft 414, self-contained faceplate compartment 434 also may comprise a protective sleeve 422 through which shaft 414 would extend to enclosed space 436 (formed by rim 426, transparent cover 428 and outer transparent crystal 430) where hands 418 and 420 may be affixed. Central apertures 433 and 437—both having the same dimensions and aligning with each other at opposite ends of sleeve 422—may be located at the base 429 and the transparent cover 428, respectively. The enclosed space 436 may be sealed to ensure unimpeded rotation of hands 418 and 420. Further, sleeve 422 may be sealed to the transparent cover 428 and the mount plate 432 to prevent dirt and moisture from entering enclosed space 436.

The horologe 410 may further comprise a outer bezel 424 surrounding the periphery of the rim 426, and affixed to the housing 423 by means of spring hinge 499. The rim 426 may include an opening 425 for alignment with opening 435 of the self-contained faceplate compartment 434. The outer bezel may be positioned so that when moved upward to an open and unlocked position (see FIG. 28), it reveals openings 425 and 435. When returned to a closed and locked position, the outer bezel 424 covers the opening 425, thereby closing and locking the faceplate compartment 434 (see FIG. 30).

Horologe 410 may further comprise a removable face 440, which is adapted for insertion into and removal from the faceplate compartment 434. Face 440 may have a larger printable design area 441, on which a design can be printed, and a smaller visible design area 443, where the design may be visible through the crystal 430. Face 440 may be made of a thin, substantially flat, flexible and resilient material. As with the previous embodiments, face 440 may be made from a woven or non-woven synthetic material, such as polyester or polyethylene or various fibrous substances, including paper. Preferably, face 440 is made of a resilient material having a thickness sufficiently thin to be received in faceplate compartment 434 and also flexible enough to slide around shaft 414 or sleeve 422.

Face 440 may include a tab 442 by which the face 440 can be held (e.g. by fingers or a tool) as it is inserted into or removed from the faceplate compartment 434. To facilitate ease of insertion and removal of the face 440, an aperture 448 and a linear passage 450 may be included. Aperture 448 in the central area of face 440 may be sufficient in size to permit face 440 to extend around shaft 414 or sleeve 422 as face 440 is inserted into or removed from faceplate compartment 434. Central aperture 448 may be round, but is preferably curved or teardrop shaped opposite tab 442. The linear passage 450 may extend radially from central aperture 448 toward opposite ends of the perimeter of the face 440. Linear passage 450 is preferably very narrow in width and is sometimes referred to as a hairline cut. Opposing edges of the linear passage 450 are preferably contacting each other or nearly contacting each other, so that face 440 appears nearly seamless when fully inserted into horologe 410.

Face 440 may include two additional features with which to facilitate the quick, easy, and smooth insertion of faceplate 440 in faceplate compartment 434. One feature is circular aperture 444 of tab 442 as one terminus point for linear passage 450, so as to allow the opposing sides of linear passage 450 to remain substantially flat as face 440 is inserted into or removed from faceplate compartment 434. The recess area 339 of faceplate compartment 334 is shaped to receive and secure lead-in 352 in a set position until face 340 is removed from horologe 310. Recess area 339 of faceplate compartment 334 is coupled with mortise 391 in rim 326 for this purpose. The other feature is lead-in 452 located at the other end of linear passage 450 opposite tab 442. As in previous embodiments, and shown in FIG. 29, the opposing edges of lead-in 452 are preferably curved for ease of use when sliding around shaft 414 or sleeve 422. The recess area 439 of faceplate compartment 434 is shaped to receive and secure lead-in 452 in a set position until face 440 is removed from horologe 410. Recess area 439 of faceplate compartment 434 is coupled with mortise 491 in rim 426 for this purpose.

Referring to FIGS. 28-30, horologe 410 of the present invention may be used by first selecting a removable face 440, which the user desires to display. The user moves the outer bezel 424 upward to the open and unlocked position (see FIG. 28) revealing openings 425 and 435. Then, holding tab 442, the user slides face 440 into faceplate compartment 434. The operation is quick and easy because of the unique and practical design of face 440—opposing edges of lead-in 452 preferably curved for ease of use when sliding around shaft 414 or sleeve 422 so that the opposing edges of linear passage 450 easily separate and when sliding around shaft 414 or sleeve 422. Because of circular aperture 444, face 440 remains substantially flat as it enters faceplate compartment 434. With face 440 correctly and completely inserted and secured in place in faceplate compartment 434, the user returns the outer bezel 424 to the closed and locked position, covering the opening 425 and essentially closing and locking the faceplate compartment 434 (see FIG. 30).

The process for removing face 440 and interchanging it with another face may be substantially the same as was described for the embodiment depicted in FIGS. 25-27 and is not discussed in detail in connection with this modification, but is illustrated in FIGS. 28-30.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A horologe comprising:

a horological movement;

a housing, which protects the horological movement, the housing having a substantially flat mount plate and a rim, the rim extending around the mount plate, wherein a portion of the rim is extendable away from the housing to reveal an opening in the housing;

an outer transparent crystal attached to the rim;

an inner transparent cover positioned between the outer crystal and the mount plate, and positioned apart from the housing to create a space between the inner cover and the mount plate so as to form a faceplate compartment;

a removable face, which is adapted for insertion into the faceplate compartment, wherein the face is thin and made of a flexible, resilient material on which graphic imagery can be applied by various techniques; and the extendable rim portion has an outer rotating bezel having an opening, the bezel being configured to be rotated so that the bezel opening selectively corresponds with the opening in the housing.

2. A horologe comprising:

a horological movement;

a housing, which protects the horological movement, the housing having a substantially flat mount plate and a rim, the rim extending around the mount plate, wherein a portion of the rim is extendable away from the housing to reveal an opening in the rim;

an outer transparent crystal attached to the rim;

an inner transparent cover positioned between the outer crystal and the mount plate, and positioned apart from the housing to create a space between the inner cover and the mount plate so as to form a faceplate compartment;

an extendable drawer, which is adapted for insertion into, and selectably extendable from, the faceplate compartment;

a removable face, residing in the drawer, wherein the face is thin and made of a flexible, resilient material on which graphic imagery can be applied by various techniques;

an extendable rim assembly, comprising the extendable rim portion, attached to the drawer, which permits the drawer to be selectively extended from the faceplate compartment, but not detached from the horologe, so as to permit the face to be removed from the drawer, and/or a different face to be inserted into the drawer; and a moveable armature ring residing in the faceplate compartment, positioned to counterbalance the drawer when the drawer is extended from the faceplate compartment.

3. The horologe of claim 2, wherein the extendable rim assembly comprises guides made of resilient, durable, yet flexible material, wherein each guide is attached to the drawer.

4. The horologe of claim 3, further comprising a track in which one of the guides may slide, and thereby movably attach the guide to the horologe, wherein the track resides in a space between the housing and the rim.

5. The horologe of claim 2, wherein the armature ring has a surface shaped similarly to a surface of the drawer, and wherein the surface of the armature ring abuts the surface of the drawer when the drawer resides fully in the faceplate compartment.

6. The horologe of claim 2, comprising a shaft operationally connected to the horological movement and extending through the mount plate in a direction that is substantially perpendicular to the mount plate; and one or more hands attached to the shaft, wherein each hand extends from the shaft in a direction that is substantially parallel to the mount plate.

7. The horologe of claim 6 embodied as a watch.

8. The horologe of claim 6 embodied as a clock.

9. The horologe of claim 6, wherein the face has a tab, an aperture at a central area of the face, and a linear passage extending substantially radially from the central area toward at least one point of the perimeter of the face, and which is able to permit passage of the shaft as the face is inserted into or removed from the faceplate compartment.

10. The horologe of claim 9, wherein the linear passage has a circular aperture as one terminus point and a lead-in, preferably with curved edges, as another terminus point.

11. The horologe of claim 2, comprising a digital display, viewable through the mount plate, and configured to communicate a time to a person.

12. The horologe of claim 11, wherein the face has an aperture or a transparent surface positioned to coincide with the display when the face resides fully in the faceplate compartment.

13. The horologe of claim 2, wherein the drawer has a centrally located aperture and a linear passage extending radially from the central aperture, both the aperture and the linear passage of a size sufficient to permit the shaft to extend therethrough.

14. The horologe of claim 2, wherein the drawer has a transparent surface positioned to coincide with the digital display when the drawer resides fully in the faceplate compartment.

15. A horologe comprising:

a horological movement;

a housing, which protects the horological movement, the housing having a substantially flat mount plate and a rim, the rim extending around the mount plate, wherein a portion of the rim is extendable away from the housing to reveal an opening in the housing;

an outer transparent crystal attached to the rim;

an inner transparent cover positioned between the outer crystal and the mount plate, and positioned apart from the housing to create a space between the inner cover and the mount plate so as to form a faceplate compartment;

a removable face, which is adapted for insertion into the faceplate compartment, wherein the face is thin and made of a flexible, resilient material on which graphic imagery can be applied b various techniques;

an undercase attached to the extendable portion of the rim, the undercase being selectively extendable away from the housing;

a hinge pivotally connecting the undercase to the rim; and an outer rotating bezel having an opening, the bezel being rotatable so that the bezel opening selectively corresponds with the opening in the housing.

* * * * *